United States Patent [19]

Cappel

[11] 3,973,762

[45] Aug. 10, 1976

[54] SINTERING PROCESS AND APPARATUS

[75] Inventor: Fred Cappel, Sprendlingen, Germany

[73] Assignee: Dravo Corporation, Pittsburgh, Pa.

[22] Filed: May 17, 1974

[21] Appl. No.: 470,914

[52] U.S. Cl. ..... 266/135; 75/5

[51] Int. Cl.[2] ..... C21B 1/18

[58] Field of Search ..... 75/5; 266/21, 135, 138, 266/157, 145, 156; 432/78

[56] References Cited

UNITED STATES PATENTS

| | | | |
|---|---|---|---|
| 3,172,754 | 3/1965 | Anthes et al. | 266/21 X |
| 3,285,735 | 11/1966 | Phelps | 266/21 X |
| 3,460,818 | 8/1969 | Greaves et al. | 266/21 |
| 3,857,694 | 12/1974 | Cappel et al. | 75/5 |
| 3,871,631 | 3/1975 | Biewinga | 266/21 |

OTHER PUBLICATIONS

Rowen, Gallagher, & Ban, "Something New in Sintering", Aug., 1957, *Iron and Steel Engineer*, pp. 133, 144.

*Primary Examiner*—Roy Lake
*Assistant Examiner*—Paul A. Bell
*Attorney, Agent, or Firm*—Parmelee, Miller, Welsh & Kratz

[57] ABSTRACT

A process and apparatus for sintering material are described wherein a moist sintered material is passed by a travelling grate through an ignition zone, a sintering zone, and a cooling zone with strand cooling of the sintered material being effected. The sintered material is passed through a purging zone of higher flow rate and lesser area than a subsequent initial cooling zone, followed by a final cooling zone. Cooling air from both the purging zone and the initial cooling zone is heated by the sintered material and removes dust particles therefrom. The resultant dust-laden air from the purging zone is de-dusted by conventional means, and the dust-containing heated air from the initial cooling zone is conducted to the sintering zone and forced downwardly through the moist material in the sintering zone. The higher pressure over a lesser area in the purging zone results in agitation of the dust in the sintered material and greater removal of dust from the material than would be possible by normal cooling processes.

7 Claims, 2 Drawing Figures

SINTERING PROCESS AND APPARATUS

BACKGROUND OF THE INVENTION

The sintering of ores, ore fines and other materials has been conventionally carried out on travelling grate type units where the ore and a fuel and flux material are placed on a travelling grate machine. The material is ignited at its surface and air drawn downwardly through the ignited mixture and, upon the flame front reaching the bottom of the bed of material, the hot sinter is discharged from the grate. The hot sinter is then generally cooled in a separate cooling unit. Although in some instances air may be drawn through the material on the grate, such usage usually greatly increases the size of suction fans used for a given rate of sinter production. The sintering operation has been plagued with problems of dust and other pollution because of the nature of the sintered material, and generally expensive dust collecting and recycling apparatus is necessary if pollution is to be controlled.

It has been found that by providing a plurality of cooling zones and by directing heated dust-laden air from a first cooling zone to the sintering zone of the travelling grate apparatus, the dust from the sintered material will be filtered from the air by the material being sintered and air from a further cooling zone can be exhausted directly to the atmosphere with strand cooling efficiently and clearly effected. Strand cooling, i.e., cooling of the sintered material while the material is still on the travelling grate apparatus, without need for the transfer of highly-heated material and the resultant dust and other transfer problems associated therewith, is highly advantageous. It has now been discovered that dust removal in a cooling step is enhanced by the use of a purging zone in which higher pressure air agitates the dust in the sintered material to further remove dust therefrom.

SUMMARY OF THE INVENTION

The sintering of material such as iron-ore fines is effected by an improved process and apparatus wherein pollution problems are abated and strand cooling effected. The material following sintering is passed from a sintering zone to a cooling zone. The first part of the cooling zone provides for a purging zone wherein cooling air is forced or induced through the sintered material at a predetermined flow rate and over a predetermined area, with the air being heated while removing dust particles from the sintered material. The material is then passed through an initial cooling zone wherein further cooling air is forced through the sintered material at a flow rate less than that in the purging zone and over an area greater than that of the purging zone. The resultant dust-laden air from the purging zone is conducted to a scrubber or similar dedusting apparatus where it is de-dusted. The heated air from the initial cooling zone is conducted to the downdraft sintering zone and forced downwardly through the material therein; which material acts to filter out the remaining dust while the sensible heat from the air aids in the sintering. The sintered material, following passage through the initial cooling zone, is passed to a final cooling step where cooling air is passed therethrough which may be exhausted to the atmosphere to provide a complete strand cooling of the sintered material.

DETAILED DESCRIPTION

Figure 1:
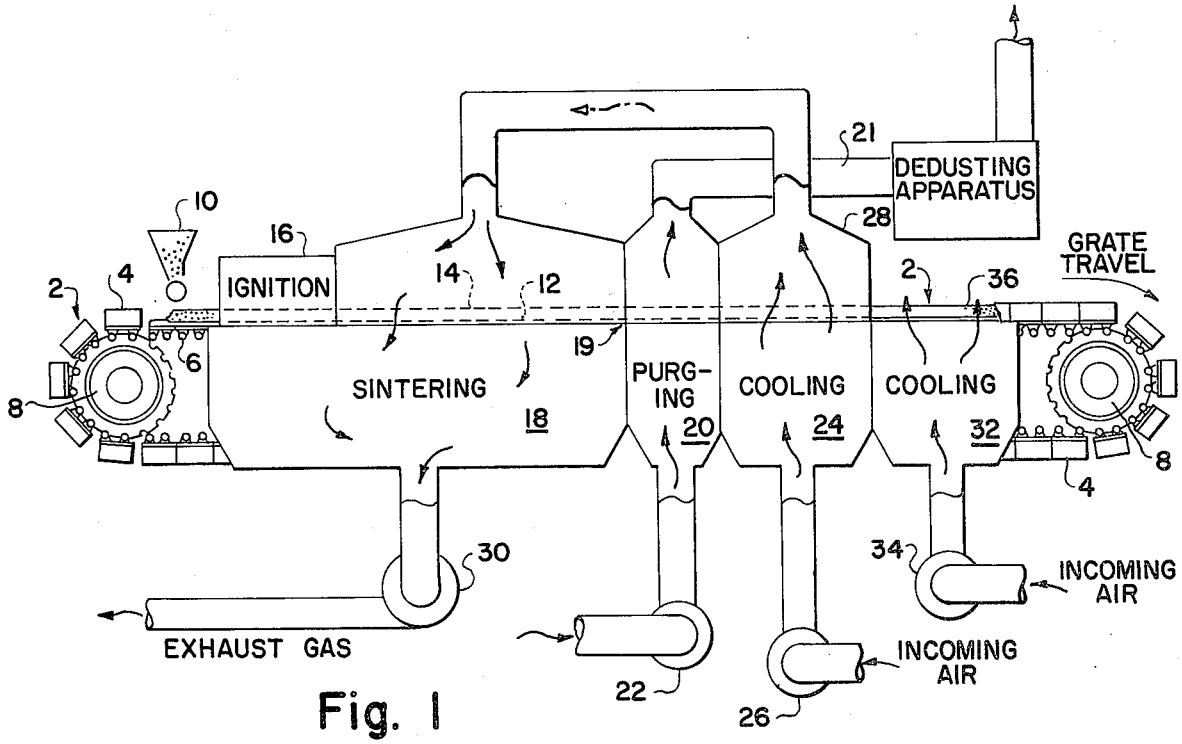
FIG. 1 is a schematic drawing of an apparatus for use with the present process showing the steps of the process.

The process and apparatus of the present invention are more readily described by reference to the attached drawings which are schematic and which illustrate the apparatus comprising known components of a "Dwight-Lloyd" or similar type sintering apparatus.

A travelling grate or sintering strand 2 is shown having a set of pallets 4 which are moved in a direction from left to right in the drawing, the pallets 4 being carried by an endless conveyor 6 travelling about sprockets or rolls 8. The material to be sintered is charged to the pallets 4 at the left side of the travelling grate 2 and the pallets 4 carry the material through the stages of ignition, sintering, purging, initial cooling, final cooling and discharge at the right side of the travelling grate 2.

The material that is to be sintered is properly blended and fed by hopper 10 to the travelling grate 2 and, as is conventional placed upon a hearth layer 12 for passage through the sintering process, the hearth layer being charged to the grate by conventional means not shown in the drawing. The hearth layer 12 and the material to be sintered 14 are first passed through an ignition zone 16 where the surface of the material is ignited and the sintering of the material initiated. The material is fused in a conventional downdraft sintering zone 18 where air is pulled through the material to cause the flame front to pass through the material and sinter the material by combustion of the fuel in the mix. The burn-through point 19, or the location in the bed where the combustion reaches the bottom of the bed of material to be sintered, is adjacent the end of the sintering zone 18. When the material passing through the sintering zone has reached the burn-through point 19, the material is completely sintered, and cooling of the sintered material must next be achieved.

In the cooling zone of the travelling grate, cooling is achieved in three consecutive steps. The first of these is a purging zone 20 in which air from a source not shown is forced or induced through the previously sintered material by a fan 22 at a predetermined flow rate and over a predetermined area. The air in the purging zone 20 is passed upwardly through the material at a pressure of from about 10–100 inches water gauge (WG). Such pressure is sufficient to cause agitation of the dust in the previously sintered material and greatly increases the removal of dust from the material. After passing through the purging zone 20, the previously sintered material is carried by the travelling grate 2 to an initial cooling zone 24 where air from a source not shown is forced through the material by a fan 26 at a flow rate less than that in the purging zone 20 over an area greater than that of the purging zone 20. Air at a pressure of from 5–50 WG partially cools the material and further removes dust therefrom. The area of the initial cooling zone is preferably about 2 to 10 times that of the purging zone.

In both the purging zone 20 and the initial cooling zone 24 the cooling air is heated by contact with the hot material and becomes laden with dust and other fine particles removed from the sintered material. The heated dust-laden air from the purging zone 20 is conducted such as by conduit 21, to a scrubber or other conventional means for de-dusting. The de-dusted air may then be exhausted to the atmosphere, or recycled back to the travelling grate. The air from the initial cooling zone 24 is enclosed within a hood 28 which is designed so that it conducts the heated air countercurrent to the travel of the grate 2 and then downwardly through the partially sintered material in the sintering zone 18. Heated dust-laden air passing through the partially sintered material in the sintering zone need not be subjected to a cleaning operation since it is directed immediately from the initial cooling zone to the sintering zone, and the sensible heat from this air assists in the sintering and permits the use of a decreasd amount of fuel in the sinter mix. In addition, the sinter, upon passage of the heated dust-laden air therethrough in the sintering zone, acts as a moist filter to remove dust and other fine particles from the air prior to exhaustion of the air from the sintering zone by means of an exhaust fan 30.

In the purging and initial cooling zones substantially all of the dust and fine particles are removed from the sintered material. After passing through the initial cooling zone 24, the sintered material is passed to a final cooling zone 32 where air from a source not shown is again forced upwardly by a fan 34 through the grate and material. Although updraft cooling is shown in the final cooling zone in the drawing, downdraft cooling may also be utilized in this step. Because of the removal of substantially all of the dust and fine particles from the material in the purging and initial cooling zones, the air from the final cooling zone 32 may be directly exhausted to the atmosphere as shown at 36. The use of multiple cooling zones and the agitation of the dust in the purging zone minimize the amount of air to be de-dusted and provide for strand cooling of the sintered material.

Figure 2:
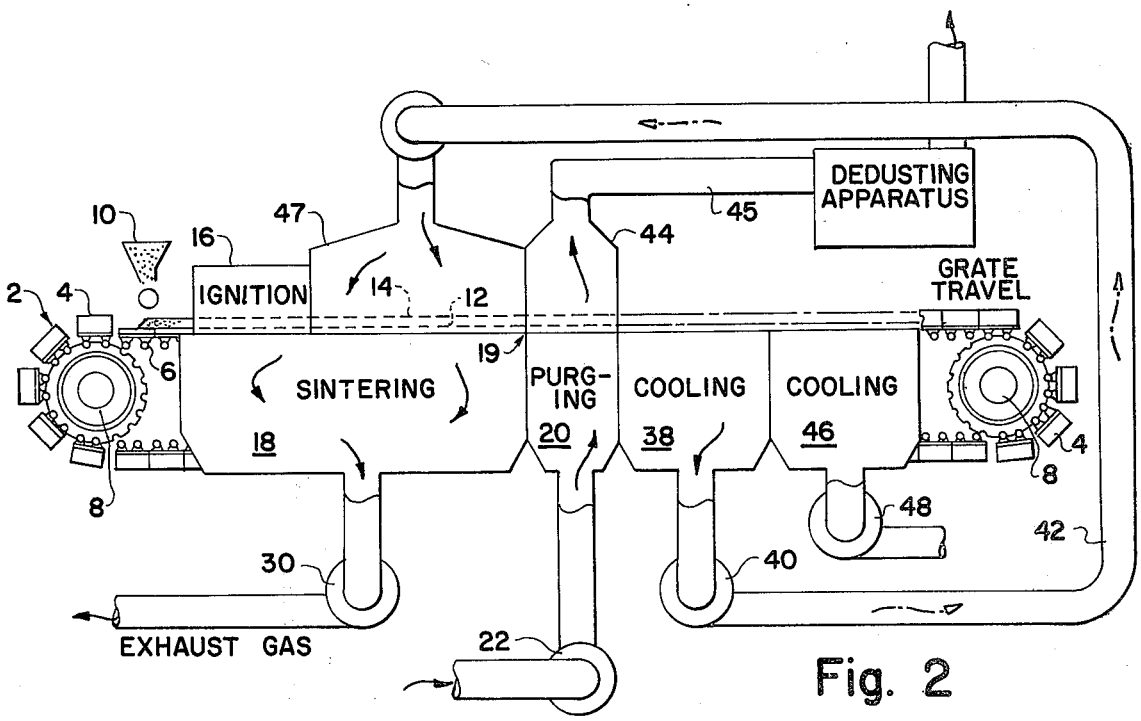
FIG. 2 is a schematic drawing of a modified apparatus for use with a further embodiment of the present process.

In the embodiment described in FIG. 2, the conventional travelling grate as before described is also used. Thus the grate 2, pallets 4, conveyor 6, rolls 8 and hopper 10 act as previously described and the hearth layer 12 and layer 14 of material to be sintered are provided on the grate. The material is ignited by the ignition furnace 16 and then passes through a downdraft sintering zone 18, which zone terminates at the burn-through point 19 of the sinter bed.

As in the first embodiment, cooling is achieved in three consecutive zones. The first of these is the purging zone 20 in which air from a source not shown is forced or induced by a fan 22 through the bed to remove a majority of the entrapped dust particles at a predetermined flow rate and over a predetermined area. As in the first embodiment, air at a pressure of 10–100 WG is sufficient to cause agitation of the dust in the previously sintered material and greatly increases the removal of dust from the material. After passing through the purging zone 20, the previously sintered material is carried by the travelling grate 2 to an initial cooling zone 38 where air is forced downwardly through the material by an exhaust fan 40 and into a conduit 42. Again the flow rate is less than that in the purging zone 20 and over an area greater than that of the purging zone 20. Air at a pressure from 5–50 WG partially cools the material and further removes dust therefrom. The area of the initial cooling zone is preferably about two to ten times that of the purging zone.

In both the purging zone 20 and the initial cooling zone 38, the cooling air is heated by contact with the hot material and becomes laden with dust and other fine particles removed from the sintered material. The heated dust-laden air from the purging zone 20 is enclosed within a hood 44 and conduit 45 which are designed so as to conduct the heated dust-laden air to a conventional de-dusting apparatus. The heated dust-laden air from the initial cooling zone 38 is passed by the exhaust fan 40 through the conduit 42 and into a hood 47. There it is passed downwardly through the partially sintered material in the sintering zone 18. As in the first embodiment, the passage of the heated dust-laden air through the partially sintered material in the sintering zone filters the dust and fine particles from the air and the heated air assists in the sintering and permits the use of a decreased amount of fuel. After passage through the partially sintered material, the air is exhausted from the sintering zone by means of an exhaust fan 30.

In the purging and initial cooling zones, substantially all of the dust and fine particles are removed from the sintered material. After passing through the initial cooling zone 38, the sintered material is passed to a final cooling zone 46 where air is drawn downwardly through the material by an exhaust fan 48. Although downdraft cooling is shown in the final cooling zone 46 in the drawing, updraft cooling may also be utilized in this zone. Because of the removal of substantially all of the dust and fine particles from the material in the purging and initial cooling zones, the air from the final cooling zone 46 may be directly exhausted to the atmosphere. The use of multiple cooling zones and the agitation of the dust in the sintered material in the purging zone allow for minimizing the use of dust collectors associated with sinter cooling and provide for strand cooling of the sintered material.

The present process while usable with conventional sinter mix, is specially suited to sintering of superflux sinter or a sinter mix which contains a high ratio of basic to acidic constituents. Preferably, the base to acid ratio, such as described by the general formula:

$$\frac{CaO + MgO}{SiO_2 + Al_2O_3}$$

would be on the order of 1.5–10. Such a high base to acid ratio provides a more permeable bed of sintered material and permits free flow of cooling air therethrough for strand cooling.

The material, including the ore fines or other metal bearing material and fuel such as coke breeze, is generally blended and the moisture content adjusted so as to provide a sinter feed material having a moisture content of about 4 to 10 percent based upon the weight of the mix, which moisture content enables trapping of dust from dust-laden cooling air as described previously.

There has been described a process for complete strand cooling of hot sinter with a cooling zone being provided which is divided into multiple cooling steps. A purging zone at high pressure agitates the material on the travelling grate and removes dust and other fine particles from the sintered material. An initial cooling zone further removes dust from the material and further cools the material on the travelling grate. The cooling air from initial cooling zone is carried directly to the sintering zone where such dust is filtered by the partially sintered material. Such purging and initial cooling and dust removal enables a final cooling zone where cooling air passed through the initially cooled sintered material may be directly exhausted to the atmosphere with resultant lessening of pollution and cost savings.

I claim:

1. In an apparatus for continuous sintering and cooling of material on a travelling grate having an ignition zone, a downdraft sintering zone extending from said ignition zone to the burn-through point of the material, an initial cooling zone having a first area and means for forcing air through the material in the initial cooling zone at a first flow rate, a final cooling zone and means for forcing air through the material in the final cooling zone, and means for collecting the air from the initial cooling zone after passage through the material and forcing said air downwardly through the material in the downdraft sintering zone, the improvement comprising:

a. a purging zone having a second area one tenth to one half the area of the first area of the initial cooling zone;

b. means for forcing air from an external source upwardly through the material in the purging zone at a second flow rate of 2 to 10 times the first flow rate in the initial cooling zone sufficient to cause agitation of the dust in the material and greatly increase the removal of dust therefrom; and c. means for de-dusting the air after passage through the purging zone.

2. In the apparatus for continuous sintering and cooling of material on a travelling grate as defined in claim

1, the improvement wherein the means for forcing air through the material in the initial cooling zone forces air upwardly through the material and wherein the air following passage through the material is then conducted directly to the downdraft sintering zone for passage through partially sintered material.

3. In the apparatus for continuous sintering and cooling of material on a travelling grate as defined in claim 2, the improvement wherein the means for forcing air through the final cooling zone forces air upwardly through the material.

4. In the apparatus for continuous sintering and cooling of material on a travelling grate as defined in claim 2, the improvement wherein the means for forcing air through the material in the final cooling zone forces air downwardly through the material.

5. In the apparatus for continuous sintering and cooling of material on a travelling grate as defined in claim 1, the improvement wherein the means for forcing air through the material in the initial cooling zone forces air downwardly through the material and wherein the air following passage through the material is then collected and conducted to the downdraft sintering zone for passage through partially sintered material.

6. In the apparatus for continuous sintering and cooling of material on a travelling grate as defined in claim 5, the improvement wherein the means for forcing air through the material in the final cooling zone forces air downwardly through the material.

7. In the apparatus for continuous sintering and cooling of material on a travelling grate as defined in claim 5, the improvement wherein the means for forcing air through the material in the final cooling zone forces air upwardly through the material.

* * * * *